United States Patent [19]

Bulso, Jr. et al.

[11] Patent Number: 4,624,125

[45] Date of Patent: Nov. 25, 1986

[54] METHOD AND APPARATUS FOR CONTROLLING THE SPACING BETWEEN A METAL FORMING PUNCH AND A COMPLEMENTAL DIE

[75] Inventors: Joseph D. Bulso, Jr., Canton; James A. McClung, North Canton, both of Ohio

[73] Assignee: Redicon Corporation, Canton, Ohio

[21] Appl. No.: 700,040

[22] Filed: Feb. 11, 1985

[51] Int. Cl.[4] ..... B21D 22/12; B21D 45/04; B21D 51/44

[52] U.S. Cl. ..... 72/453.13; 72/427; 72/465; 267/119; 413/17; 413/67

[58] Field of Search ..... 72/453.13, 465, 328, 72/427; 413/17, 67; 267/119

[56] References Cited

U.S. PATENT DOCUMENTS

| | | | |
|---|---|---|---|
| 1,930,565 | 10/1933 | Rode et al. | 72/465 |
| 2,413,591 | 12/1946 | Sturdy | 72/328 |
| 3,948,075 | 4/1976 | Finsterwalder et al. | 72/351 |
| 4,125,009 | 11/1978 | Byrd et al. | 72/350 |
| 4,206,701 | 6/1980 | Hemmelgarn | 100/257 |
| 4,207,048 | 6/1980 | Seymour | 425/151 |
| 4,249,410 | 2/1981 | Crago et al. | 72/374 |
| 4,375,785 | 3/1983 | Schoch et al. | 100/35 |
| 4,377,084 | 3/1983 | Kaminski | 72/325 |
| 4,455,114 | 6/1984 | Zysset | 413/67 |

*Primary Examiner*—Francis S. Husar
*Assistant Examiner*—Steve Katz
*Attorney, Agent, or Firm*—Reese Taylor

[57] ABSTRACT

Method and apparatus for controlling the spacing between a metal forming punch and a die pad in which the method includes supporting the work-piece on a fluid supported pad and the periphery of the work-piece on a fluid supported sleeve, engaging the workpiece with a forming punch and, during a portion of the travel of the forming punch, moving the pressure sleeve and the support pad for the central portion of the workpiece simultaneously while maintaining the spacing between the top of the pad and the bottom of the punch. The apparatus includes a die pad riser attached to the pad and to a pressure sleeve, both of which are movable in response to movement of the punch during a portion of the travel of the punch. The pressure sleeve is secured to the die pad riser so that the spacing between the punch and the die pad is maintained during such movement.

6 Claims, 4 Drawing Figures

METHOD AND APPARATUS FOR CONTROLLING THE SPACING BETWEEN A METAL FORMING PUNCH AND A COMPLEMENTAL DIE

BACKGROUND OF THE INVENTION

This invention relates, in general, to the forming of metal in a reciprocating press having a movable slide or slides which move toward and away from a fixed base. The invention relates, in particular, to apparatus of this type wherein a relatively thin piece of metal is formed and wherein it is necessary to precisely control the space or gap between the metal forming punch carried by the movable slide and the complemental forming die mounted on the bolster of the fixed base.

DESCRIPTION OF THE PRIOR ART

It is well known in forming thin metallic pieces to draw a flat sheet of metal by moving a forming punch toward and away from a fixed forming die thereby imparting the desired configuration to the workpiece.

An example of such an operation is forming what are generally called "shells" which are the end pieces of two-piece or three-piece containers for beverages or other materials by a method and apparatus of this general type.

In forming metal in this fashion, and particularly in working with workpieces of this type which are intended to become the end pieces for cans with tear-away, pop-tops tabs or full top tear-aways, it is necessary to form a score line in the metal so that, when the tab is activated, the metal can be torn away to provide access to the interior of the can or container. Needless to say, it is well known that accurate control of the depth of the score line is critical since if the score is too deep the container is subject to leakage and if the score is too shallow, the pull tab or removable piece will not function and the desired piece of metal or tab will not separate along a given score line from the body of the shell. This depth is, of course, a function of the spacing between the forming punch and the die.

Controlling this spacing is extremely difficult, particularly in instances of high speed operation where, for example, something on the order of 1,600 ends per minute or more are produced and where, for example, the material being operated on is extremely thin and where the residual metal, in the score line area, is even thinner.

The problem is complicated even further by the fact that the normal thermal expansion of the press will create press variations since as the press warms up its components will typically expand from 0.005 to 0.006 inches with the result that the gap or space will vary, and in order to achieve the desired dimension in the score area, the striking force has to be much greater in the cold condition that in the warm condition.

The prior art has generally recognized the problem of controlling the spacing between the punch and the die in this environment. Conventionally, the primary method of doing this is by providing stop blocks on the press structure itself which will restrict the closing movement of the press so as to control the space between the tooling carried by the movable member and the tooling carried by the fixed member. One difficulty with this basic approach to the problem is that it does not effectively fully compensate for the thermal expansion of the press during operation.

An example of this approach can be seen in Byrd U.S. Pat. No. 4,125,009, wherein the downward moving forming apparatus abuts a fixed spacer which thus fixes the gap between the forming member and the die. In this apparatus, the press bottoms out each cycle and since the gap or spacing is fixed, is not capable of compensating for differences in geometry due to heating of the press. A further example of this approach is disclosed by the use of spacer bars in Crago U.S. Pat. No. 4,249,410.

The difficulty with the solid stop blocks is recognized in Kaminski U.S. Pat. No. 4,377,084 wherein the usual stop blocks are augmented by resilient stop blocks which are positioned between the ram or slide and the bed of the press and which are compressed during the downward movement. Seymour U.S. Pat. No. 4,207,048 also teaches the utilization of spacers which are clamped between the tool and the ram or between the tool and the press bed. Here a heat softenable rigid plastic is employed which normally controls the spacing but is also capable of being heated and softened in the event there is a jam of the press.

Other approaches to solving the spacing problem involve controlling the shut height by using a split ring arrangement on the press driving apparatus and such an approach can been seen in Hemmelgarn U.S. Pat. No. 4,206,701.

Another approach is to attempt to obtain thermal stability in the press itself so as to control the shut height by using waste heat from the lubricant and circulating it through the drive assembly to heat the uprights to insure equal thermal growth of the uprights and the connections. Such a solution, which can be seen in Schoch U.S. Pat. No. 4,375,985, however, requires fairly complicated valving.

While all of these approaches to the problem are presumably effective for the purposes for which they are designed, it is believed that none of them really effectively provide for high speed, precisely controlled operation without stopping the press or bottoming it out on each cycle and without any modification to the press per se.

SUMMARY OF THE INVENTION

It therefore becomes an object of this invention to provide means, contained within the tooling itself, and used in a single or double acting press for controlling the spacing between the scoring punch and the forming die pad which eliminates bottoming out or stopping the press at bottom dead center on each cycle and also eliminates the need for conventional stop blocks or more complicated thermal control of the operating apparatus.

It has been found that this object can be accomplished by providing a method and apparatus wherein the space between the forming punch and the complemental die pad is controlled in a method which supports the central portion of the workpiece on a fluid supported pad and the periphery of the workpiece on a fluid supported sleeve. The method further involves engaging the workpiece with the forming punch and overcoming the supporting pressure on the sleeve during a portion of the travel thereof. In this fashion, it has been found that the space between the die pad and the forming punch in the critical area of the score can be adequately controlled.

It has been found that apparatus for carrying out this method can be achieved by securing a punch riser to the movable platen of the press and a punch to the punch riser while a die pad riser is fluidly supported on the fixed base in opposed relation thereto. A pressure sleeve is also fluidly supported on the fixed base in concentric relationship with the die pad and is designed so as to be movable with the punch through a portion of the travel of the movable platen simultaneously with movement of the die pad riser through the same portion of the travel thereof.

Accordingly, production of an improved method and apparatus for controlling the spacing between a scoring punch and a forming die pad of the character above-described becomes a principal object of this invention with other objects thereof becoming more apparent upon a reading of the following brief specification considered and interpreted in view of the accompanying drawings.

OF THE DRAWINGS

BRIEF DESCRIPTION OF THE PREFERRED EMBODIMENTS

Figure 1:
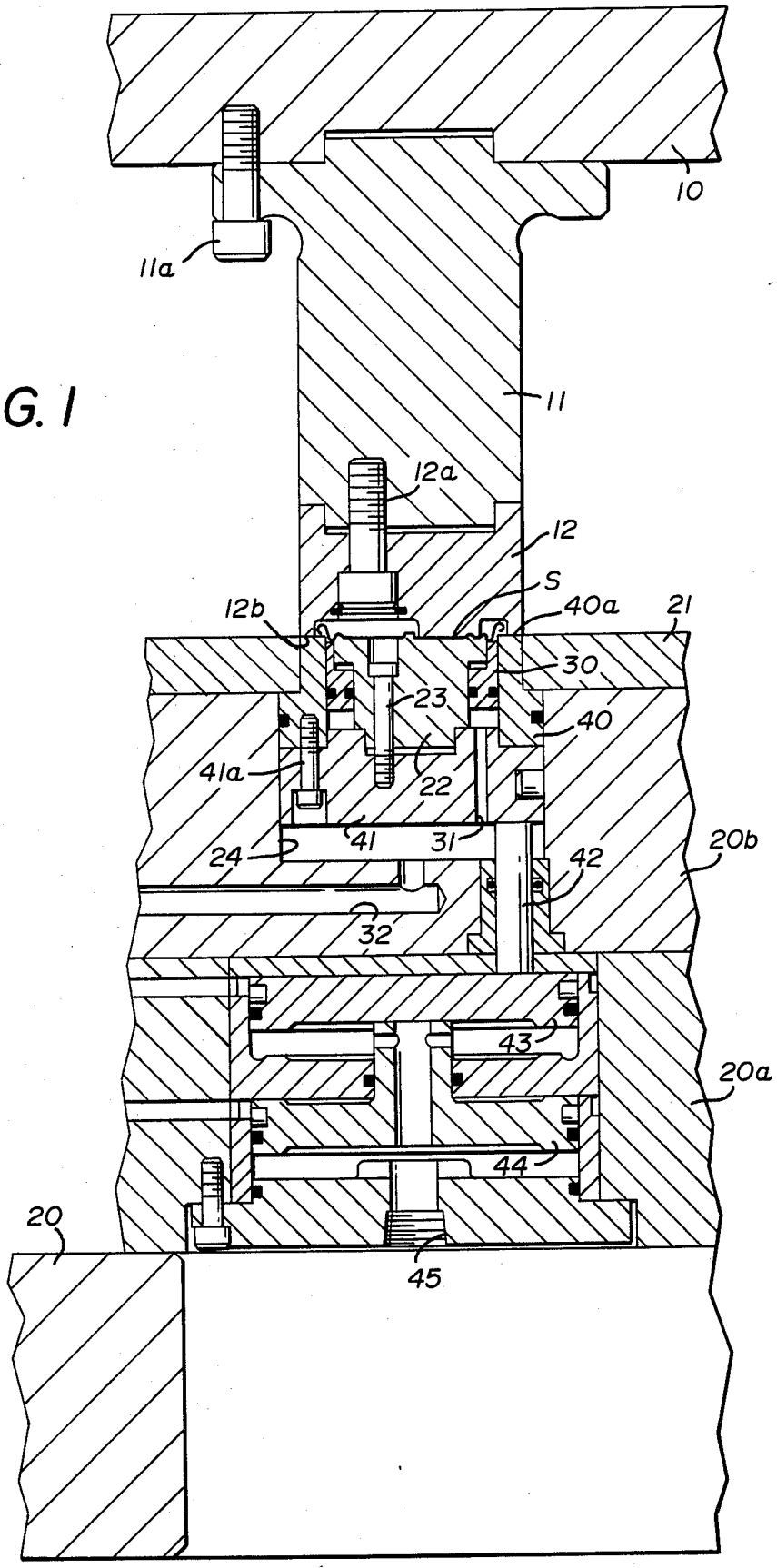
FIG. 1 is an elevational view, in section, showing the tooling necessary to carry out the method and apparatus of the invention.

Referring then to FIG. 1 of the drawings for a description of the overall tooling, it is first noted that the concept of the method and apparatus of this invention are utilizable with either a single or double acting press. The drawings illustrate, and the description will describe, utilization of the concept with only a single acting press with a single slide 10.

To that end and referring to FIG. 1, it will be noted that a punch riser 11 is secured to the slide 10 by the screws 11*a*. Adjustably attached to the punch riser 11 is the punch 12 which is secured thereto by the screw 12*a*. The punch 12 has suitable contours on its bottom or projecting surface so as to accommodate the configuration of the "shelf" and also so as to impart the score line to the shell during operation, as will be described in greater detail below.

The fixed base 20 of the press supports a bolster 20*a* and a die holder 20*b* which carries, on its top surface, cover plate 21 which retains the various components of the tooling not carried by the slide 10.

In that regard, a forming die pad 22 is secured by means of the screw 23 to a die pad riser 41. The die pad riser 41 and the die pad 22 are movable together within the opening 24 in the die holder 20*b* and would normally be urged to the upper position shown in FIG. 1 of the drawings, for example, by hydraulic or pneumatic pressure.

Figure 2:
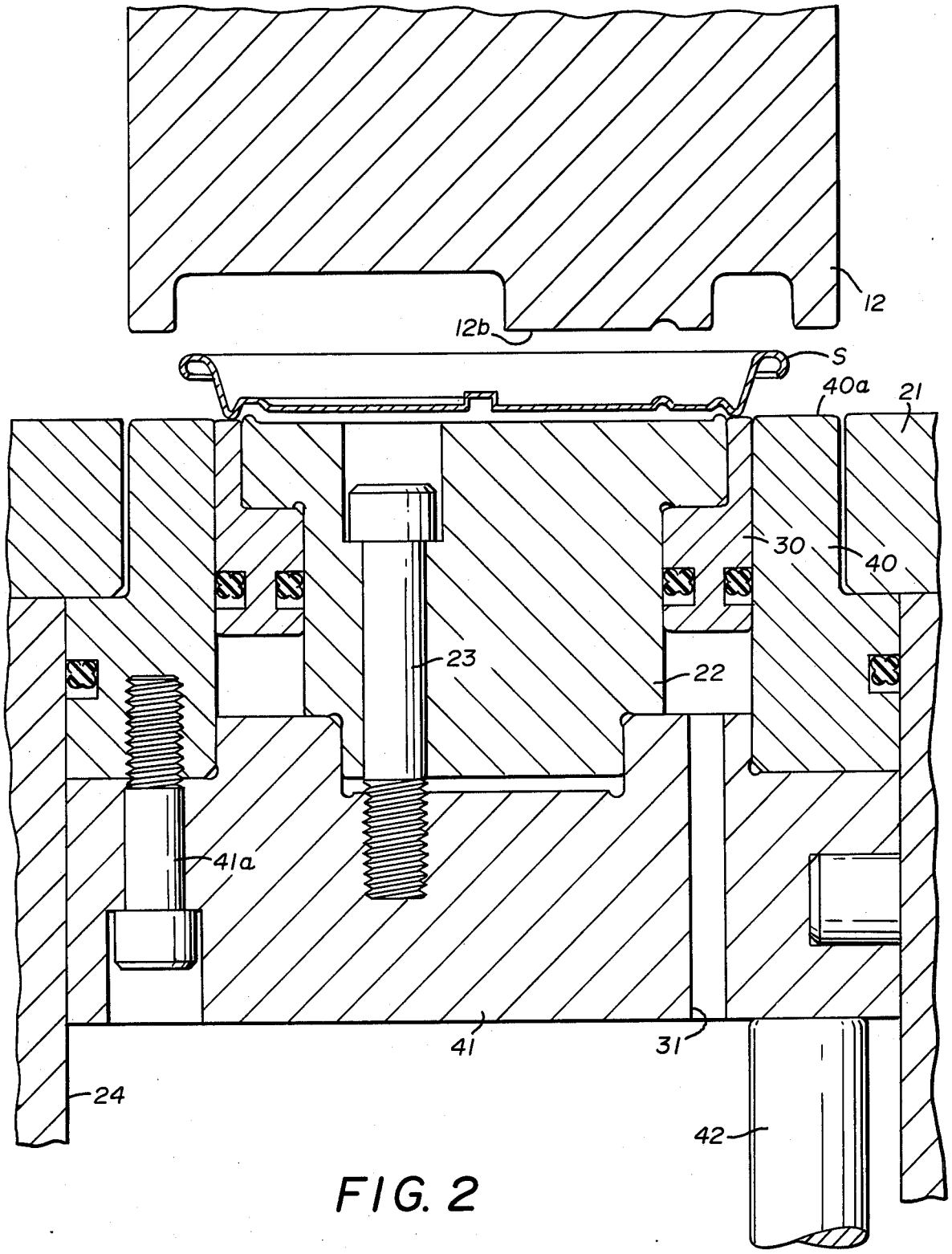
FIG. 2 is a partial elevational view showing the tooling in the opened condition prior to forming of the score line.
Figure 3:
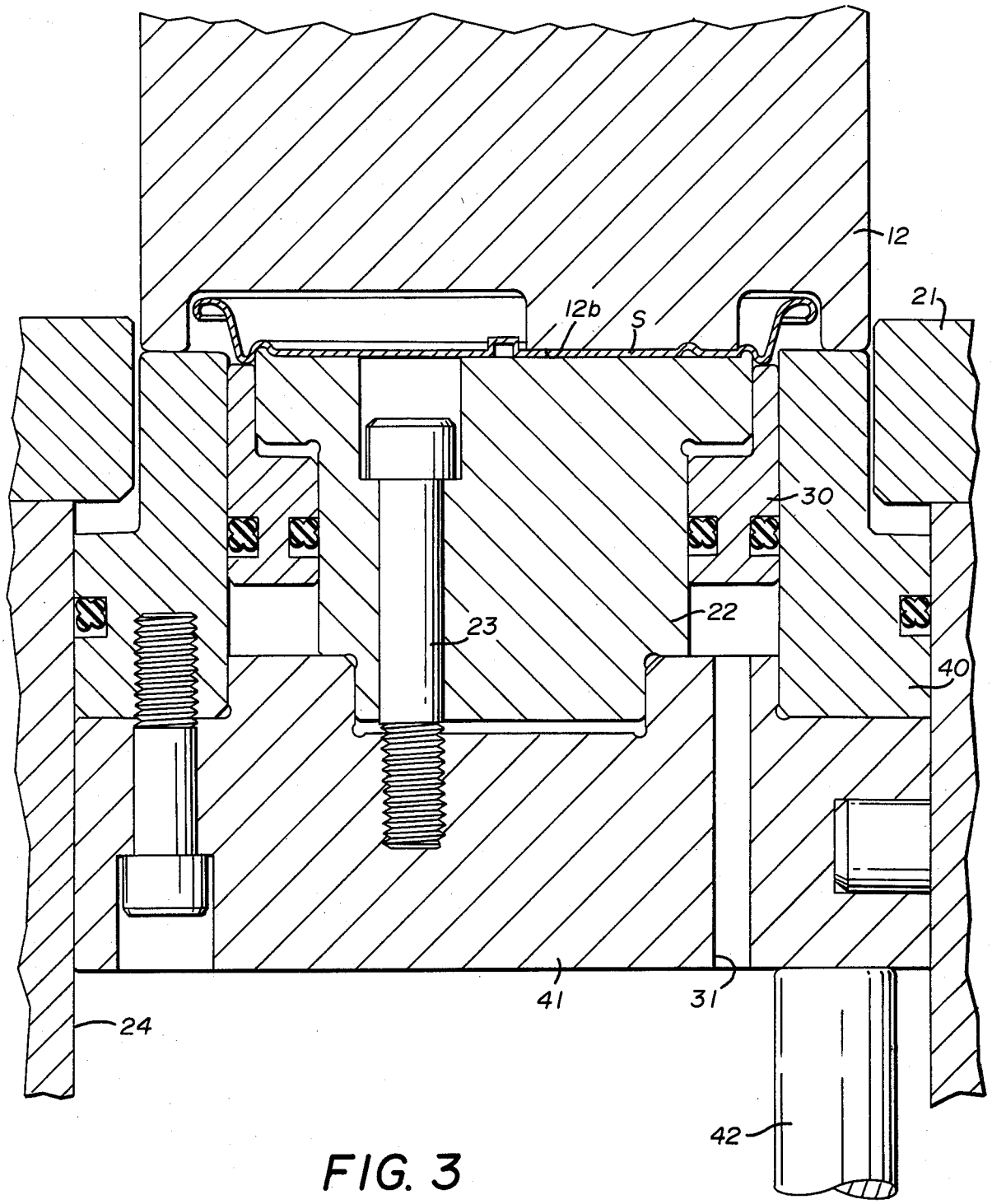
FIG. 3 is a partial elevational view, in section, showing the score being formed.
Figure 4:
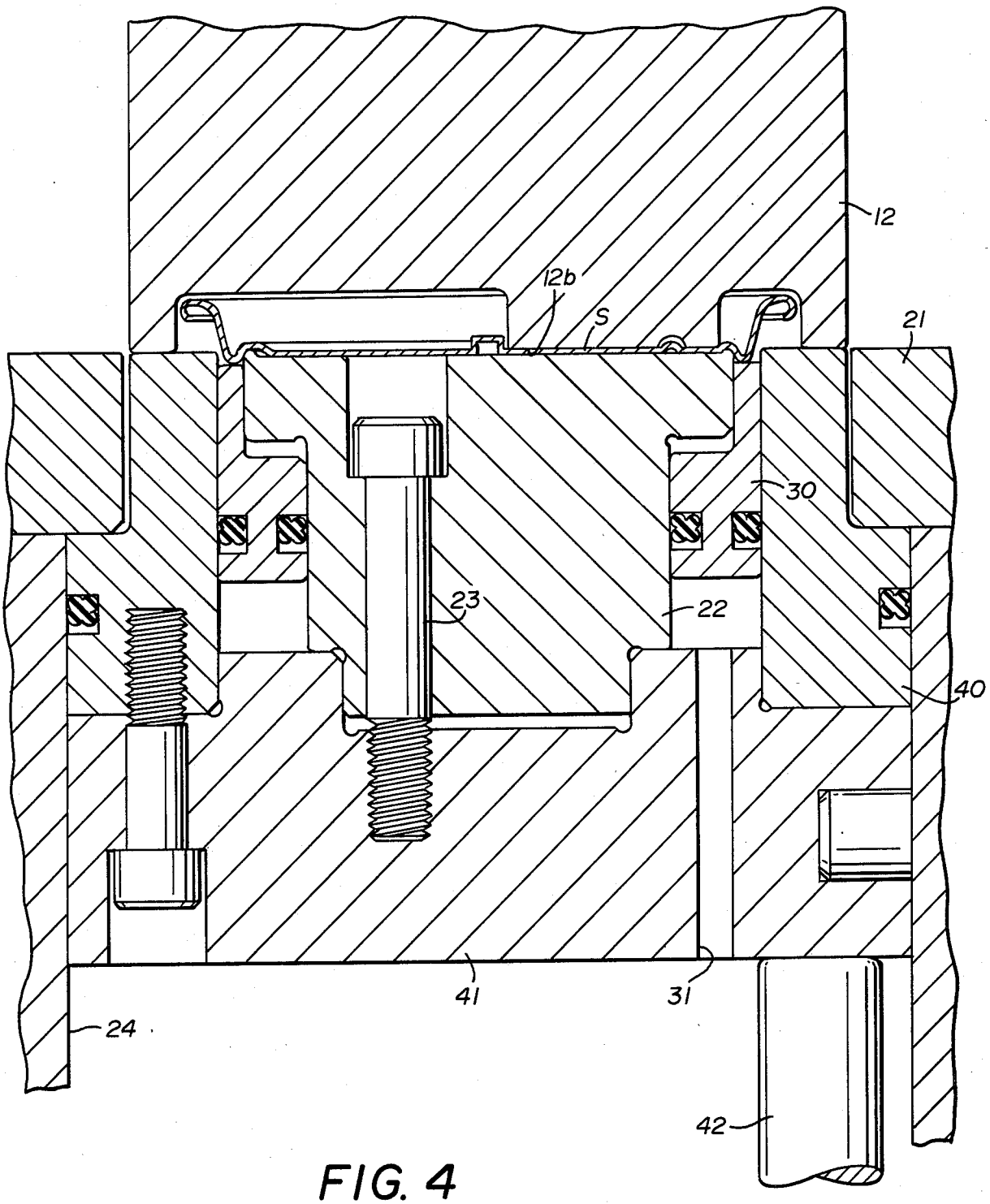
FIG. 4 is an elevational, sectional view showing the position of the tooling following forming of the score.

Also carried in the die holder 20*b* of the press is a lift out ring 30 which is disposed concentrically with respect to the forming die pad 22 and which is reciprocal between the positions, for example, of FIG. 2 and FIG. 3 of the drawings. Fluid pressure through the lines 31 in die holder 41 and 32 in die pad riser 20*b* is normally sufficient to urge the lift out ring 30 to the upper position of FIG. 2.

A pressure sleeve 40 is also received for reciprocation within the die holder 20*b* and is secured to and supported on riser 41 by screw 41*a*. The riser is, in turn, supported by piston rod 42 and pistons 43 and 44 carried by bolster 20*a*. These pistons are either hydraulically or pneumatically operated by fluid pressure through the port 45 in bolster 20*a*. Normally they will exert sufficient pressure beneath the pressure sleeve 40 and riser 41 to form a solid support for the scoring operation.

To that end, in use or operation of the improved method and apparatus, as the slide 10 moves toward the fixed base 20 it will bring with it the punch riser 11 and the punch 12. This tooling will contact the shell S and the suitable contours carried on the bottom surface 12*b* of the punch 12 will impart, in cooperation with the forming die pad 22, the score line.

It should be kept in mind here that the critical relationship is the gap or space between the bottom surface 12*b* of the punch 12 and the top surfaces of die pad 22 and top surface 40*a* of the pressure sleeve 40. During downward movement of punch 12, at some point contact is made with shell S which is trapped between the punch 12 and the top of the sleeve 40. The score line is then formed. Such downward movement of the slide 10 and the punch 12 will force the pressure sleeve 40 downwardly from the position, for example, of FIG. 2 to the position of FIG. 3. It will be noted from the drawings that as pressure sleeve 40 is forced downwardly under pressure from punch 12, it will carry die pad riser 41 and die pad 22 with it, which will force die pad riser 41 and die pad 22 downward simultaneously. During this movement, the force imparted to punch 12 by slide 10 overcomes the fluid pressure on pistons 43 and 44 which is normally sufficient to provide a sufficiently solid support for the scoring operation but which can be overcome, as noted, by the downward force imparted by the slide 10. This insures that at all times during movement of the slide 10 toward the base 20, the space between the surface 12*b* and the surface 40*a* is accurately controlled.

It will also be noted that the pressure through lines 31 and 32, which acts on lift out ring 30, is also overcome during this downard movement.

As slide 10 then pulls away from lower platen 20, the fluid pressure on pistons 43 and 44 will move die pad riser 41, die pad 22 and pressure sleeve 40 back to the position of FIG. 2, ready for another cycle once scored shell S has been removed for transfer to another station for further operations and replaced by another. Also during this time, pressure through lines 31 and 32 will activate lift out ring 30 to move scored shell S to the die line for engagement with suitable transfer means. No detail has been illustrated with respect to the required transfer means, which are well known in the art.

The control of the spacing between punch 12 and die pad 22 is independent of thermal expansion of the press and is achieved entirely by the replaceable tooling which is attached to or affixed to the press. Therefore, no modification of the press is required and no utilization of any complicated thermal compensation means are required. Nevertheless, the precise depth of the score is very accurately and effectively controlled. This makes it possible to achieve the required depth of score with a cold press or with a hot press and eliminates the need for increasing the tonnage of the press to achieve an adequate depth of score with a cold press. Furthermore, such an arrangement permits forming of the score line without bottoming out in each cycle.

While a full and complete description of the invention has been set forth in accordance with the dictates of the Patent Statutes, it should be understood that modifications can be resorted to without departing from the spirit hereof or the scope of the appended claims.

To that end, it should be noted that the invention has basically been illustrated and described in a specific environment, namely that of imparting a score line to a shell for use on a two- or three-piece container. It should be understood that the invention is not intended to be limited solely to use in producing that specific part and has equal utility wherever it is desired to control the gap or spacing between the punch and the die pad without modification of the press.

What is claimed is:

1. A method of forming a workpiece in a press having at least one movable slide and a fixed platen by controlling the space between a metal forming punch carried by the slide and a complemental die carried by the fixed platen comprising the steps of:

(a) supporting a central portion of the workpiece on a central portion of a fluid supported die pad means supported by a predetermined fluid pressure;

(b) supporting the periphery of the workpiece on a first fluid supported sleeve supported by a predetermined fluid pressure and surrounding the central portion of the die pad means;

(c) engaging the workpiece with the forming punch against the central portion of the die pad means and engaging a second fluid supported sleeve with an outer peripheral portion of the punch to define a space between the punch and the central portion of the die pad means; and (d) overcoming the fluid pressure supporting the die pad means and the second sleeve by further movement of the punch to move the second fluid supported sleeve and the die pad means together while maintaining the defined space between the pad and the punch.

2. The method of claim 1 wherein said second fluid supported sleeve is fixed to said pad.

3. In a press having at least one movable slide and a fixed base, the improvement comprising:

(a) a punch secured to the movable slide for movement therewith and having a work engaging area and an outer, peripheral non-work engaging portion;

(b) a die pad fluidly supported by a predetermined fluid pressure on the fixed base in opposed relationship with said work engaging area of said punch;

(c) a pressure sleeve fluidly supported by a predetermined fluid pressure on the fixed base in concentric relationship with said die pad and in opposed relationship with said non-work engaging portion of said punch; and (d) said non-work engaging portion of said punch engaging said pressure sleeve upon movement of said movable slide toward said base to define a space between said work engaging area and said die pad;

(e) said pressure sleeve and said die pad moving with said punch upon further movement of said movable slide toward said base against the bias of said predetermined fluid pressures.

4. The apparatus of claim 3 wherein a die pad riser is attached to said die pad; and said pressure sleeve is fixed to said die pad riser.

5. The apparatus of claim 4 wherein at least one fluid supported piston is carried by the fixed base in supporting relationship with said die pad riser.

6. The apparatus of claim 3 wherein a fluid supported lift out ring is carried by the fixed platen in concentric relationship with said die pad and between said die pad and said pressure sleeve.

* * * * *